US007481173B2

(12) United States Patent
Pollack et al.

(10) Patent No.: US 7,481,173 B2
(45) Date of Patent: Jan. 27, 2009

(54) FLOATING LOWERING AND LIFTING DEVICE

(75) Inventors: Jack Pollack, Monte Carlo (MC); Nabil Demian, Houston, TX (US); Hein Wille, Eze (FR)

(73) Assignee: SBM-IMODCO, Inc., Houston, TX (US)

( * ) Notice: Subject to any disclaimer, the term of this patent is extended or adjusted under 35 U.S.C. 154(b) by 29 days.

(21) Appl. No.: 11/629,965

(22) PCT Filed: Apr. 20, 2005

(86) PCT No.: PCT/IB2005/002487

§ 371 (c)(1),
(2), (4) Date: Dec. 18, 2006

(87) PCT Pub. No.: WO2006/000919

PCT Pub. Date: Jan. 5, 2006

(65) Prior Publication Data

US 2008/0060568 A1 Mar. 13, 2008

(30) Foreign Application Priority Data

Jun. 23, 2004 (EP) ..... 04076820

(51) Int. Cl.
*B63C 7/00* (2006.01)

(52) U.S. Cl. ..... 114/51

(58) Field of Classification Search ..... 114/49–53
See application file for complete search history.

(56) References Cited

U.S. PATENT DOCUMENTS

| | | | | |
|---|---|---|---|---|
| 3,536,023 | A * | 10/1970 | Bascom et al. | 114/259 |
| 3,807,334 | A * | 4/1974 | Egeberg | 114/268 |
| 4,280,430 | A * | 7/1981 | Wilson et al. | 114/51 |
| 2007/0089656 | A1 * | 4/2007 | Baylot | 114/53 |

FOREIGN PATENT DOCUMENTS

WO WO 2004/012990 2/2004

* cited by examiner

*Primary Examiner*—Ed Swinehart
(74) *Attorney, Agent, or Firm*—The Webb Law Firm

(57) ABSTRACT

The invention relates to a floating lowering and lifting device having a floating structure and a lifting unit lowerable from the floating structure towards the sea bed, the lifting unit having a chamber with at least one gas-inlet opening in its wall and an equalization opening in its wall, a gas supply mechanism being connected to the gas inlet opening, the device having a controller connected to the gas supply mechanism for controlling a gas supply rate to the chamber. The chamber has a releasable coupling member for releasably attaching to a load and is connected via a lifting cable to a take up device on the floating structure for lengthening and shortening the lifting cable.

8 Claims, 6 Drawing Sheets

FLOATING LOWERING AND LIFTING DEVICE

BACKGROUND OF THE INVENTION

1. Field of the Invention

The invention relates to a floating lowering and lifting device comprising a floating structure and a lifting unit lowerable from the floating structure towards the sea bed, the lifting unit having a chamber and a releasable coupling member for releasably attaching to a load, the chamber being connected via a lifting cable to a take up device on the floating structure for lengthening and shortening the lifting cable, the lifting unit comprises a weight balancing member attached with an upper end to the lifting cable and with a lower end to the chamber.

2. Description of Related Art

It is known to lower large weight loads (templates for example) onto the seabed with cables from a floating barge. A problem with prior art systems which use a tensioned connection between the weight and the floating vessel, like a cable, to take the weight, is that due to the movements of the floating vessel snap tensions will be introduced in the cable.

As very long cables and very large weights are used, these snap tensions can break the cable (this problem is solved by the construction according to U.S. Pat. No. 5,190,107, a heave compensating support system for positioning a sub sea work package). In very deep waters and with very large weights, the diameter and the weight of the cables are becoming to big to handle: for example the weight of a 6 inch cable of 1000 m is about 100 tons and the diameter of the cable will be to big to handle. It is possible to use devices to lower packages onto the seabed with the help of pressurized closed buoyancy cans. The cans must be so constructed to withstand the water pressure at seabed level; every 10 m water depth will add 1 bar. Such a system is shown in the above U.S. Pat. No. 5,190,107. The buoyancy can of U.S. Pat. No. 5,190,107 comprises a heave compensating system formed by a chain part at the end of the lifting cable, the lower end of the chain part attaching to the bottom of the buoyancy can. The natural frequency of the vessel at the sea surface is thereby decoupled from the motions of the buoyancy can. By varying the distribution of the length of the chain that depends in a loop from either the lifting cable or the buoyancy can, the trimming of the buoyancy is adjusted and the speed of raising and lowering can be varied. It was found that the construction wherein the catenary chain is situated on one side of the buoyancy can results in difficulties when maneuvering the buoyancy can from the surface vessel in a lateral direction (parallel to the sea bed). Furthermore, upon closer approach of the buoyancy can to structures on the sea bed, the pending chain can be in the way and may collide with the sub sea structures unless sufficient distance is maintained.

Very deep waters have relative high pressures at seabed level. This, combined with the relatively large weight to be transported makes the use of closed buoyant cans or modules very expensive due to the size of such a buoyancy module and the construction needed to avoid collapsing of the buoyancy module.

It is therefore an object of the present invention to provide a lowering and lifting device for lifting our lowering relatively heavy weights in deep water.

It is a further object of the present invention to provide a lowering and lifting device which can be raised and lowered in a controlled manner using a simple and reliable control system.

It is a further object of the present invention to provide a lowering a lifting device which can be accurately maneuvered above the sea surface, in particular in a lateral direction.

It is again an object of the present invention to provide a lowering and lifting device which can be brought into close proximity to the sea bed or to a structure on the sea bed, without interference of the weight balancing member.

It is another object of the present invention to provide a lowering and lifting device which can maintain an accurately defined volume of air in its interior.

SUMMARY OF THE INVENTION

Thereto, in the lowering and lifting device according to present invention the lifting cable is in line with a longitudinal centre line of the chamber, the weight balancing member being symmetric with respect to a plane going through the longitudinal centre line, the chamber comprising at least one gas-inlet opening in its wall connected to a gas supply means and an equalisation opening in its wall communicating with the sea.

The device according to the present invention can be used for lowering to the seabed of heavy loads (500 tons or more) in relative deep water (for example 1000 m). The lifting unit can be connected to and disconnected from the load and includes a large, "soft volume" structure which has an opening to the environment in the lower part and which can be filled with a gas above its opening to add buoyancy. Due to the fact that the chamber if the lifting unit is not a closed pressure module, the construction can be relative simple and can be constructed at low costs as there will be no pressure differences between the inside and the outside of the module. The gas (air) inside the open chamber will compensate the weight of the chamber and the weight of the load to be transported to or from the seabed, at any position during the lowering and raising. Adding gas will ensure a controlled lowering/deployment of the combination of the device and the connected package, for example creating an uplift of 490-500 tons at a load of 500 tons. During the way down, gas (such as for instance air or Nitrogen) needs to be added into the chamber as the gas trapped in it the will be reduced in volume due to the increase of the external water pressure. The combination of lifting device and load sinks due to the resultant small negative buoyancy of the combination, which can be controlled, from the floating barge by a vent system on the module. After depositing the load on the seabed, gas is removed from the chamber via a gas release mechanism to maintain neutral buoyancy on small positive buoyancy after disconnecting of the load such that the lifting unit can be retrieved at the water surface.

By the use of a weight balancing member which is symmetrical with respect to the longitudinal centre line (this also includes constructions in which the weight balancing member extends along the longitudinal centre line), the lifting unit of the present invention is in all cases properly balanced, while at the same time being decoupled from wave motions of the surface vessel. An accurately determined vertical position of the lifting unit of the present invention can be maintained. The symmetric arrangement of the weight balancing member furthermore allows accurate and small lateral displacements to be carried out for aligning the lifted load with equipment on the seabed. Also the fact that the lifting cable is in line with the centre line of the lifting unit improves the maneuverability of the lifting unit.

It is noted that an open lifting unit is described in WO 2004/012990 in the name of the applicant. No weight balancing means are described in this publication.

The control means connected to the gas supply means can comprise for instance an electrically or mechanically controlled valve in a gas supply duct to the chamber, or a remote control valve on the chamber which is actuated by means of a sonar system or radio transmitter or any equivalent means such as fibre optics or any other signal carriers.

During operation, the gas inlet opening is during use situated higher along a longitudinal height of the lifting unit than the equalisation opening. Gas introduced into the chamber will accumulate at the top whereas pressure equalisation with the surroundings takes place through the lower equalisation opening.

The gas supply means may, according to one embodiment, be placed on the floating structure, a fluid supply duct connecting the gas supply means to the chamber. The fluid supply duct may be a flexible duct can be connected to a container with compressed gas or a compressor supplying gas to the chamber with an over pressure. The control means may comprise a valve connected to the supply duct, which can be actuated from on board the floating structure or may be formed of a power control operatively associated with the compressor to regulate the compressor output, or combinations thereof.

The gas supply means can comprise a container which is connected to the chamber via a controllable valve, the container comprising compressed gas and being lowerable with the chamber, the control means being connected to the valve for controlling the gas supply to the chamber. The control means may comprise a cable connected to a supply setting unit on board of the vessel on one side and connected to the valve which is lowered with the chamber on the other side. The cable may comprise electrical, optical or other means of signal transmission. Alternatively, an acoustic receiver may be comprised on the valve being lowered with the chamber whereas a transmitter is placed on board of the vessel. Again, a radio transmitter may be comprised on board of the vessel whereas the receiver is connected to the valve of the container connected to the chamber for opening or closing said valve.

Even though the chamber has a controlled buoyancy during raising and/or lowering of the load, the lifting unit may be connected to the vessel via a guide cable for assisting in station keeping of the lifting unit and for preventing drift or positional change with respect to the vessel and for retrieval of the lifting unit on board of the vessel.

For positional adjustment, the chamber may be provided with one or more thrusters powered via the control line. For heave compensation an tensional equalisation in the guide cable and/or control line, the guide line or control line may be connected to an arm on the floating structure, the arm comprising a sheeve and a counter weight attached to the sheeve via an arm, the sheeve being suspended from said arm. This way a heave compensating adjustment is achieved. For controlled raising or lowering a gas release mechanism is connected to a control means adapted to be opened upon detaching the releasable coupling member from the load. In this way, the buoyancy of the unit can be reduced prior to detaching of the load and the lifting unit will not be accelerated upwards by its reduced mass, but can be raised to the surface in a controlled manner.

In a first embodiment, the weight balancing member comprises a transverse beam attached to the lifting cable, wherein, from each end of the beam an elongate weight member is suspended with an upper end, a lower end of the elongate weight member being attached to a support on the outside of the chamber, the weight members forming a loop. The symmetric arrangement of looped weight members, which can be formed by chains, forms a robust and simple balancing and wave-motion decoupling construction. The length of the weight members can be chosen such as to not substantially extend below a lower end of the chamber to avoid interference with structures on the sea bed during maneuvering.

A receiving frame may be attached to a top part of the chamber for carrying the transverse beam when the chamber is in its lowermost position on or near the sea bed and when the chamber is being deployed from the surface vessel.

In an alternative embodiment, the lower end of the lifting cable extends inside the chamber, and is lowerable into the chamber, a weight member being attached to the lower end of the lifting cable, a stopper element being attached to the lifting cable inside the chamber, for engaging with the chamber wall. By lowering a number of weight members into the chamber by paying out the lifting cable, the chamber is loaded and will descend more rapidly. A separate compartment may be provided in the chamber for receiving the weight member.

BRIEF DESCRIPTION OF THE DRAWINGS

Some embodiments of a floating lowering and lifting device according to the present invention, will, by way of example, be explained in detail with reference to the accompanying drawings. In the drawings.

DETAILED DESCRIPTION OF THE INVENTION

Figure 1:
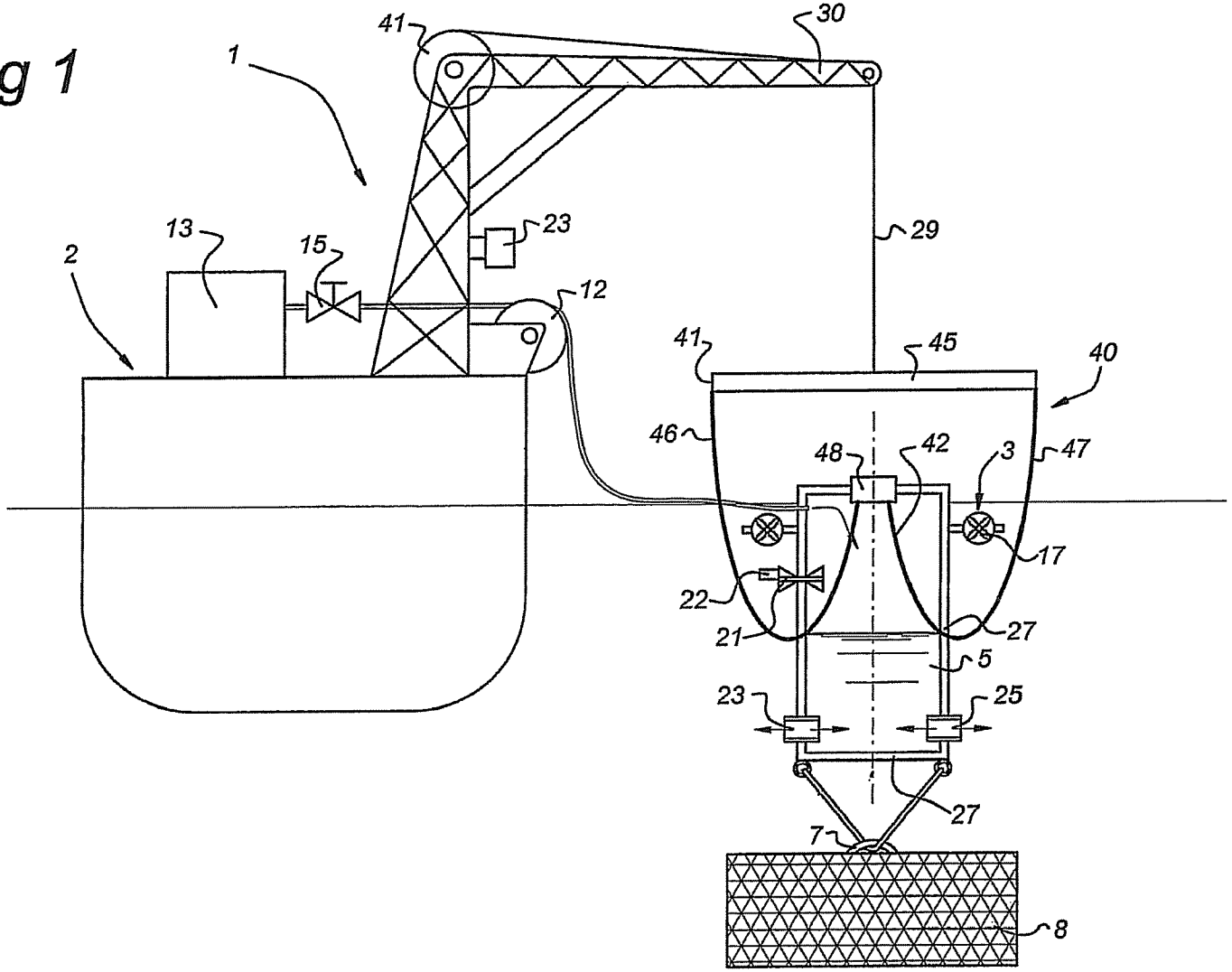
FIG. 1 shows a schematic view of the first embodiment, including a weight balancing member, in which the chamber of the lifting device is supplied with gas from floating structure.

FIG. 1 shows a floating lowering and lifting device 1 comprising a vessel or barge 2 and a lifting unit 3. Lifting unit 3 comprises a chamber 5 provided with a releasable coupling member 7 carrying a load 8 that is to be raised from or lowered to the seabed. The chamber 5 comprises gas inlet opening 9 which is connected to a gas supply hose 11. The air hose 11 may be wound on an air hose reel 12 and may be attached to gas supply means 13 which may formed of a compressor or which may be a storage tanker comprising gas or compressed gas. A control valve 15 may be included in the air hose 11 for increasing or decreasing the gas supply rate from the tank of compressed air 13. The chamber 5 comprises furthermore a thruster 17 for positioning of the chamber and a controllable gas release valve 21, which may comprise a sonar detector 22 for communicating with sonar transmitter 23 for opening or closing of the valve 21. Sonar transmitter 23 may be operated from the vessel 2. Furthermore, the chamber 5 comprises equalisation openings 23, 25 in the lower wall portion near the bottom 27 of the chamber 5 for equalizing the pressure inside the chamber 5 with the ambient pressure. By controlling the valve 15, the gas supply rate to the chamber 5 is adjusted such as to lower the load 8 in a controlled manner at the same time the air hose is wound from the reel 12. For positional purposes and for retrieval of the chamber 5 onto the vessel, the chamber 5 is connected to a guide cable 29 that is connected to a crane 30 on the vessel, and to a winch 41 a weight balancing member 40 is attached to the chamber 5 and comprises in this embodiment a transverse beam 45 that is attached to the lifting/guide cable 29. The weight balancing member 40 comprises two or more looped chains 46,47 that are with their upper ends 41 attached to the beam 45 and with their lower ends 42 to a support 48 on the outside of the chamber 5.

Figure 2:
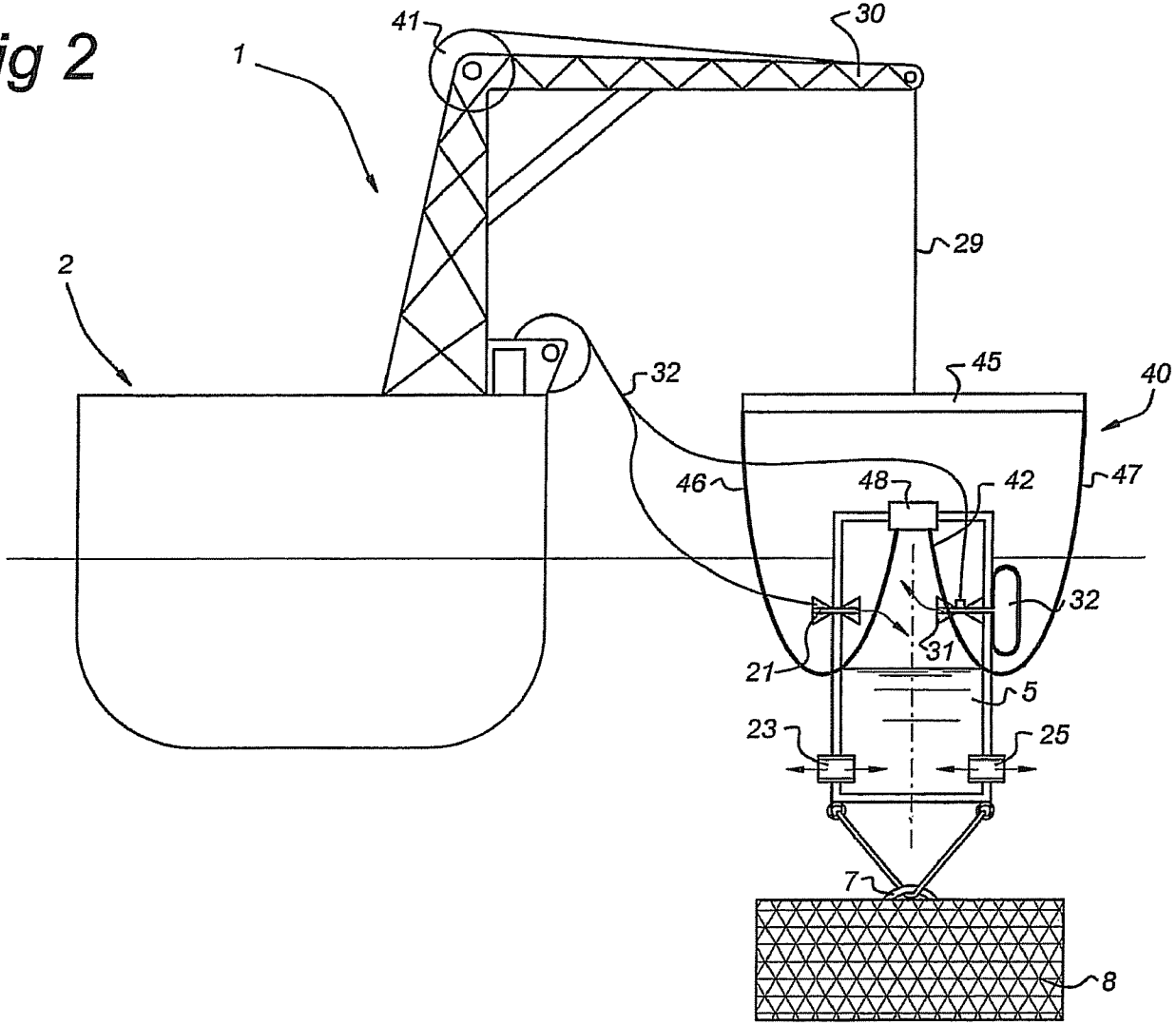
FIG. 2 is an embodiment, including a weight balancing member, in which the chamber of the lifting device is provided with a compressed gas source connected to the chamber.

FIG. 2 shows an embodiment in which tank 32 comprising compressed nitrogen is attached to the chamber 5. Compressed nitrogen can be entered into chamber 5 via a controllable valve 31 which is connected to electric signal control cable 32, operated from onboard of the vessel 2. A release valve 21 which can be electrically controlled is also connected via cable 32 to a control unit 33 on board of the vessel 2. Instead of via a cable 32, the valves 21, 31 may be operated via a radiographic control or via sonar or even via remote operated vehicle (ROV) which is lowered together with the chamber 5 and which is operated from a control unit on board of the vessel 2.

Figure 3:
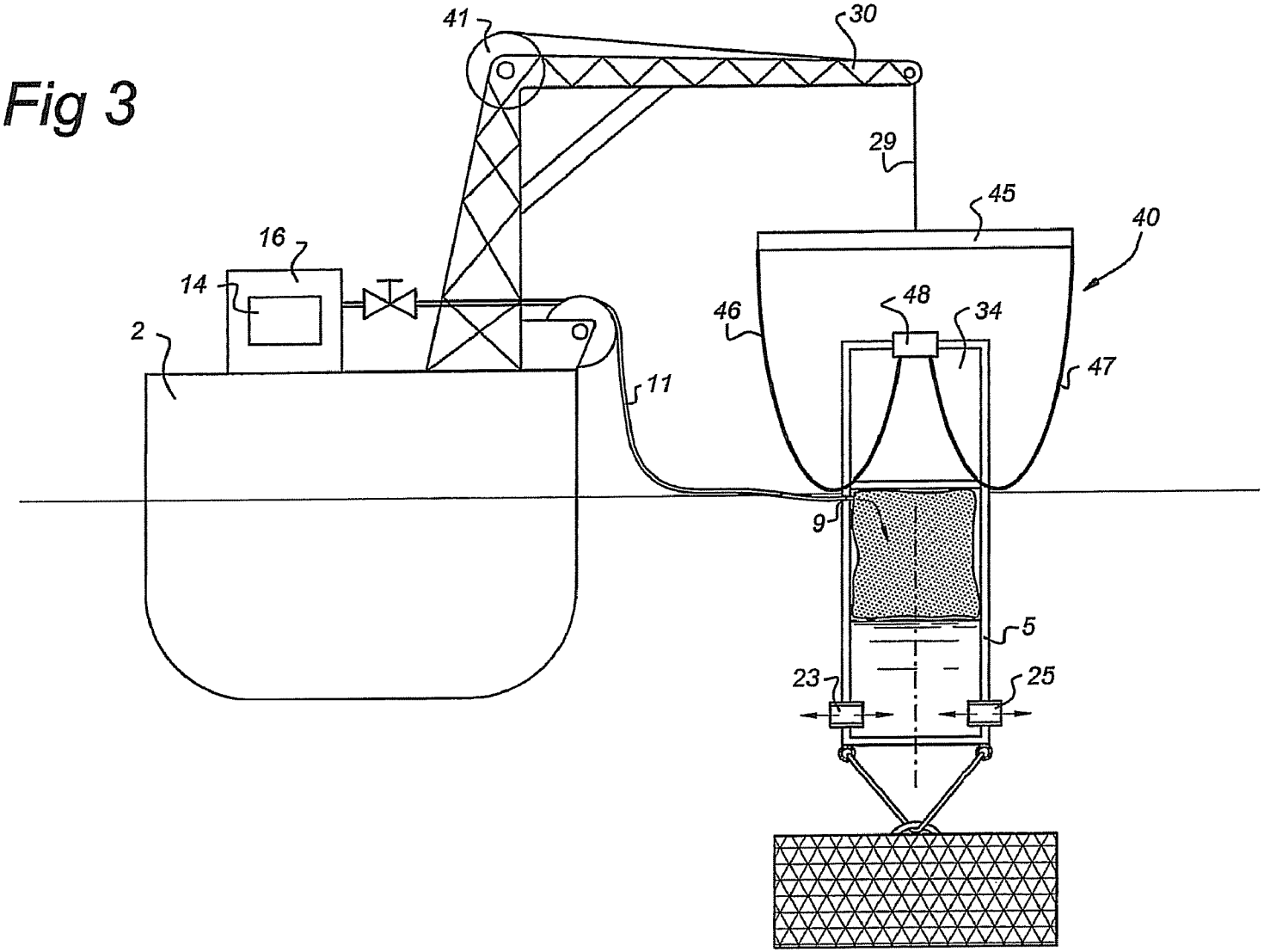
FIG. 3 is an embodiment, including a weight balancing member, in which a closed volume filled with foam or gas is comprised in the device.

In the embodiment of FIG. 3 the chamber 5 comprises a closed volume 34 with permanent buoyancy comprising air or foam. The amount of air or foam in the enclosed space 34 may be just sufficient for providing a neutral buoyancy of the chamber 5 when the load has been deposited on the seabed.

Once the load has been deposited on the seabed, the gas in the chamber 5 that was compensating for the weight of the load 8 must be ventilated when the seabed will take the weight of the load upon lowering of the load 8 and pressural transmission of its weight onto the seabed, the release valve 21 (see FIG. 2) is operated to gradually release gas from the chamber 5 to prevent the chamber 5 from rocketing up to sea level. During the upwards trajectory gas is released via gas release valve 21 in a controlled manner for a controlled lift. Upon lowering of the chamber 5, gas is introduced into the chamber 5 in a controlled manner via valve 15 or 31 to compensate for the volume reduction of the gas by increased compression with increasing water depth. For this purpose the valve 15 and/or the compressor 16 on board of the vessel 2 may be operated in a way which is controlled by the water depth of the chamber 5.

The air hose 11 can be a relatively small diameter flexible tube. The guide cable 29 of the floating barge 2 can be of relatively small dimensions as it does not need to take the weight of the whole chamber 5 and the load 8, as the combined chamber 5 and load 8 are maintained generally near neutral buoyancy. The function of the guide cable 21 is to guide or to keep the track of the device 3 and the load 8 and to take up a limited amount of weight (for example the cable is able to take 10 tons at a combined weight of load 8 and chamber 5 of for instance 500 tons). Together with the air hose 11 an umbilical may be connected to the chamber 5 for operating thruster 17 and/or for controlling the air release valve 21 in FIG. 1.

In the compressor 16 in FIG. 3, a power control 14 is present for relating the air supply to chamber 5 in dependence of the water depth.

Figure 4:
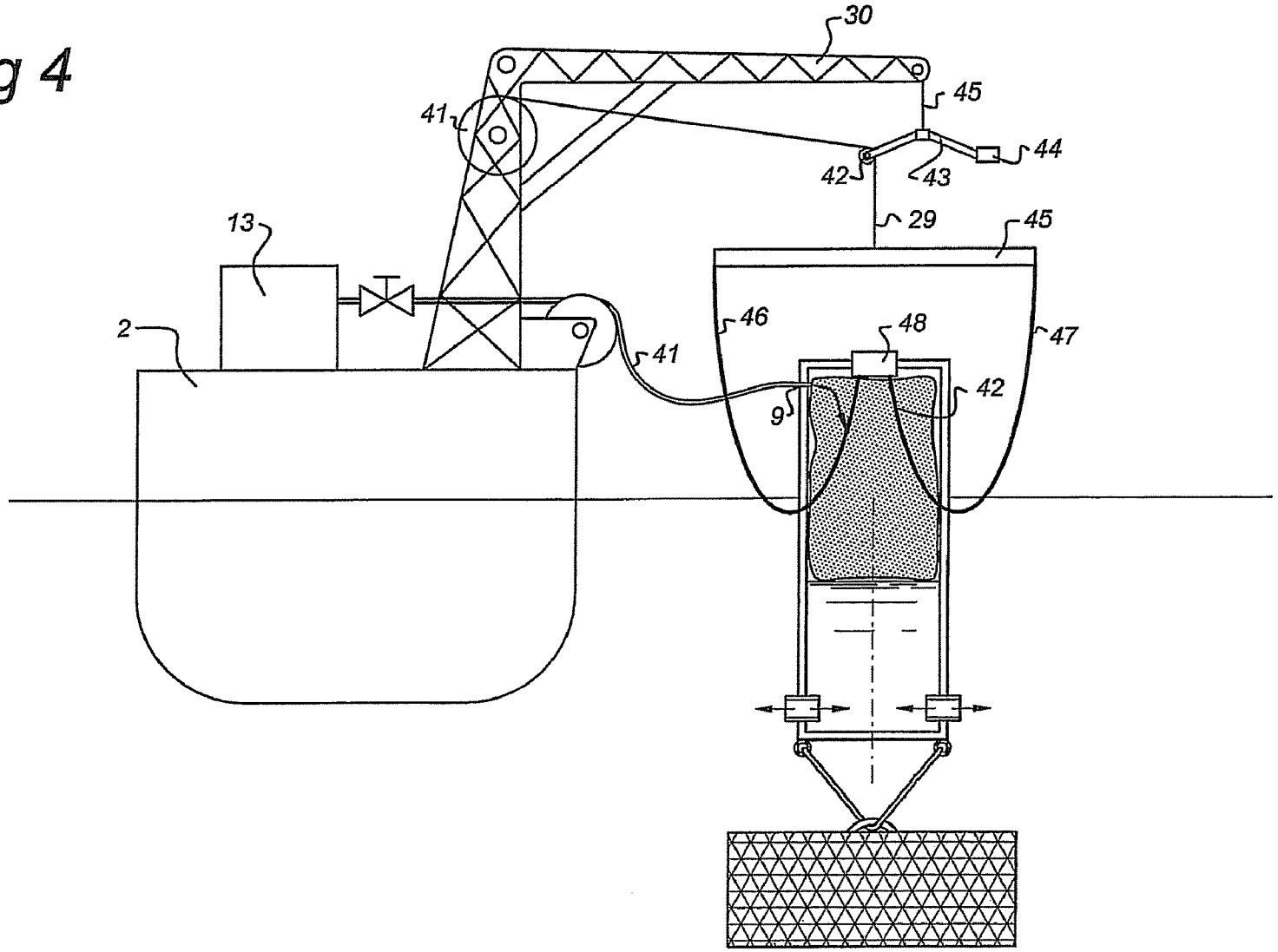
FIG. 4 is an embodiment, including a weight balancing member, comprising a ship heave and roll compensating mechanism.

Finally in FIG. 4, it is shown that the guide cable 29 is connected to a sheeve 42 at the end of an arm 43. At the second end of the arm 43 a counter weight 44 is provided. The arm 43 is near its midpoint connected to a cable 45 attached to crane 30. The guide cable 29 is wound on a winch 41. By the arm 43, a heave/roll compensating device is provided which prevents large tensioned loading in the guide cable 29 upon heave-induced motions and roll of the vessel 2.

Figure 5:
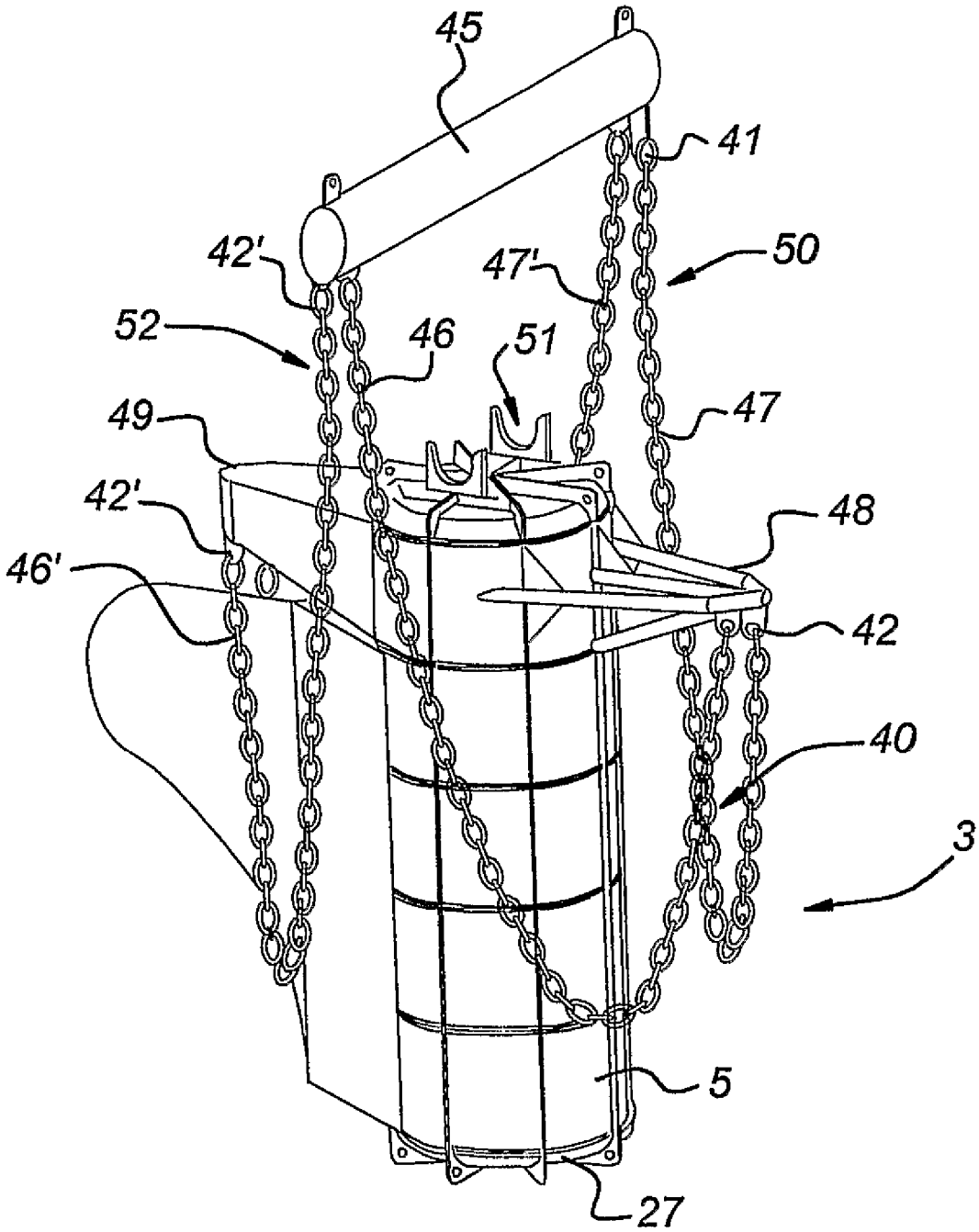
FIG. 5 shows a perspective view of the chamber of the lifting device and the external attachment of the weight balancing member.

FIG. 5 shows the lifting unit 3 with the transverse beam 45 carrying two pairs 50,52 of chains 46,46', 47, 47'. The chains are with their lower ends 42, 42' connected to diagonally opposed supports 48,49 and with their uppers ends 41,41' to the transverse beam 45. The upper part of the chamber is provided with a receiving frame 51 in which the transverse beam 45 can be received when the guide/lifting cable 29 goes slack. The length of the chains 46, 46'; 47,47' is so short that the looped chains do not substantially extend below the chamber 5 when the transverse beam is situated in the receiving frame 51.

Figure 6:
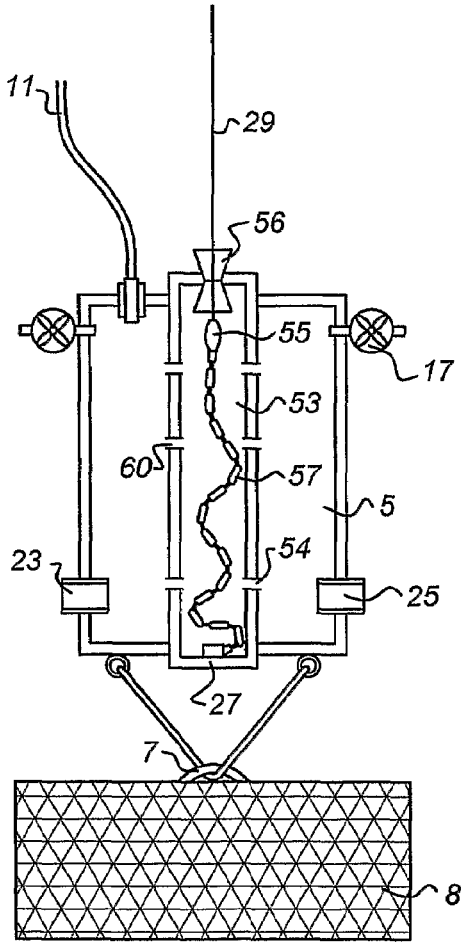
FIG. 6 shows an embodiment of an internal weight balancing member.

FIG. 6 shows an embodiment wherein a chain 57 is attached to the lower end of lifting cable 29. The chain 57 is received in an inner compartment 53 situated within chamber 5. At the upper end, the cable 29 is provided with a stopper 55, which engages with a lifting surface 56 through which the cable 29 is guided through the chamber wall, into the compartment 53. By lowering or raising the chain 57, the weight of the chain resting on the bottom of the chamber 5 can be varied and hence the speed of descent or ascent of the chamber 5 can be varied. Via openings or perforations 60, the compartment 53 may be in fluid communication with the chamber 5 and hence with the deep sea environment, via equalisation openings 23, 25 in the chamber wall.

Alternatively, the compartment 53 may be sealed from the chamber 5 and can have a separate equalization opening in communication with the deep sea environment.

It is noted that even though two equalisation openings 23, 25 are shown, the invention also covers embodiments comprising a single equalisation opening.

Figure 7:
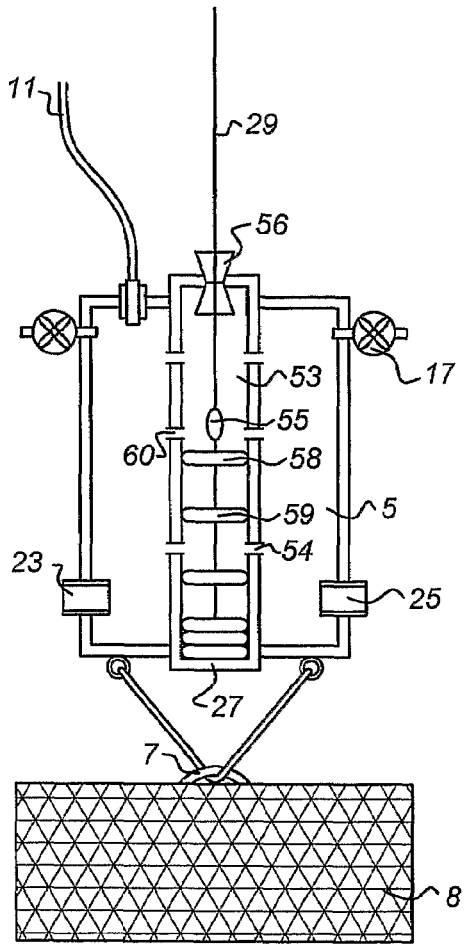
FIG. 7 shows a further embodiment of an internal weight balancing member.

In the embodiment of FIG. 7, the weight member comprises separate weights 58, 59 at spaced-apart locations along the lower end of the cable 29.

The invention claimed is:

1. A floating lowering and lifting device comprising a floating structure and a lifting unit lowerable from the floating structure towards the sea bed, the lifting unit having a chamber and a releasable coupling member for releasably attaching to a load, the chamber being connected via a lifting cable to a take up device on the floating structure for lengthening and shortening the lifting cable, the lifting unit comprises a weight balancing member attached with an upper end to the lifting cable and with a lower end to the chamber, wherein the lifting cable is at least generally in line with a longitudinal centre line of the chamber, the weight balancing member being symmetric with respect to a plane going through the longitudinal centre line, the chamber comprising at least one gas-inlet opening in a wall of the chamber connected to a gas supply means and an equalization opening in a wall of the chamber communicating with the environment of the chamber.

2. The floating lowering and lifting device according to claim 1, wherein the weight balancing member comprises a transverse beam attached to the lifting cable, wherein, from each end of the beam an elongate weight member is suspended with an upper end, a lower end of the elongate weight member being attached to a support on the outside of the chamber, the elongate weight members forming a loop.

3. The floating lowering and lifting device according to claim 2, the chamber comprising two diagonally opposed supports, a set of at least two elongate weight members extending from each end of the transverse beam to a respective support.

4. The floating lowering and lifting device according to claim 2, the length of the elongate weight members being such that the elongate weight members do not substantially extend below a lower end of the chamber when the transverse beam is situated at an upper part of the chamber.

5. The floating lowering and lifting device according to claim 2, the upper part of the chamber comprising a receiving frame for receiving the transverse beam.

6. The floating lowering and lifting device according to claim 2, the lower end of the lifting cable extending inside the chamber, and being lowerable into the chamber, a weight member being attached to the lower end of the lifting cable, a stopper element being attached to the lifting cable inside the chamber, for engaging with the chamber wall.

7. The floating lowering and lifting device according to claim 6, the weight member being lowerable into a central compartment of the chamber.

8. The floating lowering and lifting device according to claim 2, the elongate weight member comprising a chain.

* * * * *